US008465401B1

(12) United States Patent
Ihli et al.

(10) Patent No.: US 8,465,401 B1
(45) Date of Patent: Jun. 18, 2013

(54) PORTABLE EXERCISE APPARATUS AND METHODS

(76) Inventors: Stephen P. Ihli, Santa Monica, CA (US); Mark A. Krull, New Braunfels, TX (US)

( * ) Notice: Subject to any disclaimer, the term of this patent is extended or adjusted under 35 U.S.C. 154(b) by 106 days.

(21) Appl. No.: 12/927,252

(22) Filed: Nov. 10, 2010

Related U.S. Application Data

(60) Provisional application No. 61/281,021, filed on Nov. 12, 2009.

(51) Int. Cl.
*A63B 21/015* (2006.01)
*A63B 21/045* (2006.01)

(52) U.S. Cl.
USPC ..... 482/126; 482/116; 482/91

(58) Field of Classification Search
USPC ..... 482/121, 122, 123, 124, 125, 126, 482/127, 129, 116, 91, 120, 908
See application file for complete search history.

(56) References Cited

U.S. PATENT DOCUMENTS

| | | | | | |
|---|---|---|---|---|---|
| 650,656 | A | * | 5/1900 | Raabe | 482/124 |
| 766,743 | A | | 8/1904 | Terry | 482/127 |
| 913,799 | A | | 3/1909 | Burguet | 482/127 |
| 1,390,095 | A | | 9/1921 | Dettinger | 482/129 |
| 1,573,362 | A | | 2/1926 | Stovall | 482/148 |
| 1,954,762 | A | | 3/1932 | Wolff | 482/127 |
| 2,951,702 | A | | 5/1958 | Goodwin | 482/127 |
| 2,959,414 | A | * | 11/1960 | Saltz | 482/127 |
| 3,841,627 | A | | 10/1974 | Vetter | 482/110 |
| 3,885,789 | A | | 5/1975 | Deluty | 482/120 |
| 4,174,832 | A | | 11/1979 | Thompson | 482/120 |
| 4,328,965 | A | | 5/1982 | Hatfield | 482/122 |
| 4,625,962 | A | | 12/1986 | Street | 482/116 |
| 4,779,866 | A | * | 10/1988 | Marshall et al. | 482/116 |
| 4,948,119 | A | | 8/1990 | Robertson | 482/56 |
| 5,226,867 | A | | 7/1993 | Beal | 482/127 |
| 5,324,243 | A | | 6/1994 | Wilkinson | 482/92 |
| 5,358,461 | A | | 10/1994 | Bailey | 482/2 |
| 5,437,591 | A | | 8/1995 | Chen | 482/127 |
| 5,486,149 | A | | 1/1996 | Smith | 482/120 |
| 5,509,873 | A | | 4/1996 | Corn | 482/74 |
| 5,618,249 | A | | 4/1997 | Marshall | 482/127 |
| 5,709,637 | A | | 1/1998 | Gow | 82/129 |
| 5,733,231 | A | | 3/1998 | Corn | 482/120 |
| 5,755,646 | A | | 5/1998 | Chu | 82/118 |
| 5,792,034 | A | * | 8/1998 | Kozlovsky | 482/124 |
| 5,876,310 | A | | 3/1999 | Mackey et al. | 482/74 |
| 6,099,447 | A | | 8/2000 | Ramsaroop | 482/127 |
| 6,149,559 | A | | 11/2000 | Mackey | 482/124 |
| 6,283,899 | B1 | | 9/2001 | Charnitski | 482/110 |
| 6,315,701 | B1 | | 11/2001 | Shifferaw | 482/114 |
| 6,544,152 | B2 | * | 4/2003 | Rosati | 482/126 |
| 6,726,607 | B1 | | 4/2004 | Ihli | 482/127 |
| 6,770,014 | B2 | * | 8/2004 | Amore | 482/92 |
| 7,087,001 | B1 | * | 8/2006 | Ihli | 482/115 |

(Continued)

*Primary Examiner* — Stephen Crow

(57) ABSTRACT

Left and right resistance devices are configured and arranged in different ways to accommodate different types of exercises. In one arrangement, the resistance devices are connected to respective ends of a bar. In one exercise, a person stands on the bar and pulls on handles connected to flexible members emanating from the resistance devices. In another exercise, a person sits down, supports the bar on her feet, and pulls on the handles. In another arrangement, the resistance devices are instead connected to a pole, and the person pulls on the handles. In yet another arrangement, the resistance devices are connected to a person's hands and/or feet, and the flexible members are connected to a harness secured about the person's torso.

19 Claims, 7 Drawing Sheets

U.S. PATENT DOCUMENTS 7,250,021 B2 * 7/2007 Leight ..... 482/116
7,322,909 B1 * 1/2008 Loccarini et al. ..... 482/129
2003/0211920 A1 * 11/2003 Mandel ..... 482/116
2006/0040805 A1 * 2/2006 Wilkinson ..... 482/124

* cited by examiner

PORTABLE EXERCISE APPARATUS AND METHODS

CROSS-REFERENCE TO RELATED APPLICATION

Disclosed herein is subject matter that is entitled to the filing date of U.S. Provisional Application No. 61/281,021, filed Nov. 12, 2009.

FIELD OF THE INVENTION

The present invention relates to methods and apparatus for exercising muscles of the human body, and more specifically, to exercise equipment that may be carried by a person without assistance.

BACKGROUND OF THE INVENTION

An object of the present invention is to provide improved portable exercise apparatus and methods.

SUMMARY OF THE INVENTION

In one sense, the present invention may be described in terms of a portable exercise kit for use by a person. One such kit preferably includes an elongate bar, a left resistance device selectively mounted on a left end of the bar, and a right resistance device selectively mounted of a right end of the bar. A left force receiving member is connected to a flexible member emanating from the left resistance device, and a right force receiving member is connected to a flexible member emanating from the right resistance device. The bar is preferably configured to support the foot of a standing person, and alternatively, to be supported on the feet of a sitting person.

Another such kit preferably includes a harness, a left resistance device sized and configured to be held in a person's left hand, and a right resistance device sized and configured to be held in a person's right hand. The harness is connected to a flexible member emanating from the left resistance device, and to a flexible member emanating from the right resistance device. The resistance devices are also sized and configured to be secured to a person's respective left and right feet. Yet another kit includes a post strap in addition to the harness. Moreover, the bar described above with reference to the first kit may be combined with these other kits to create still more kits.

The present invention may also be described in terms of methods of exercise performed by a person, and such methods may be described with reference to any of the foregoing kits. For example, one such method involves a first mode of operation, wherein the bar is placed on a support surface, and the person stands on an intermediate portion of the bar, and a second mode of operation, wherein the person sits on the support surface, and uses her feet to hold the bar at an elevation above the floor surface. In each mode, the person uses her left arm to extract a flexible member from the left resistance device, and uses her right arm to extract a flexible member from the right resistance device.

In another method, a person dons the harness, secures the left resistance device in her left hand, and secures the right resistance device in her right hand. She connects the harness to a flexible member emanating from the left resistance device, and to a flexible member emanating from the right resistance device. She then moves her left arm to extract the flexible member from the left resistance device, and moves her right arm to extract the flexible member from the right resistance device. Many features and advantages of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
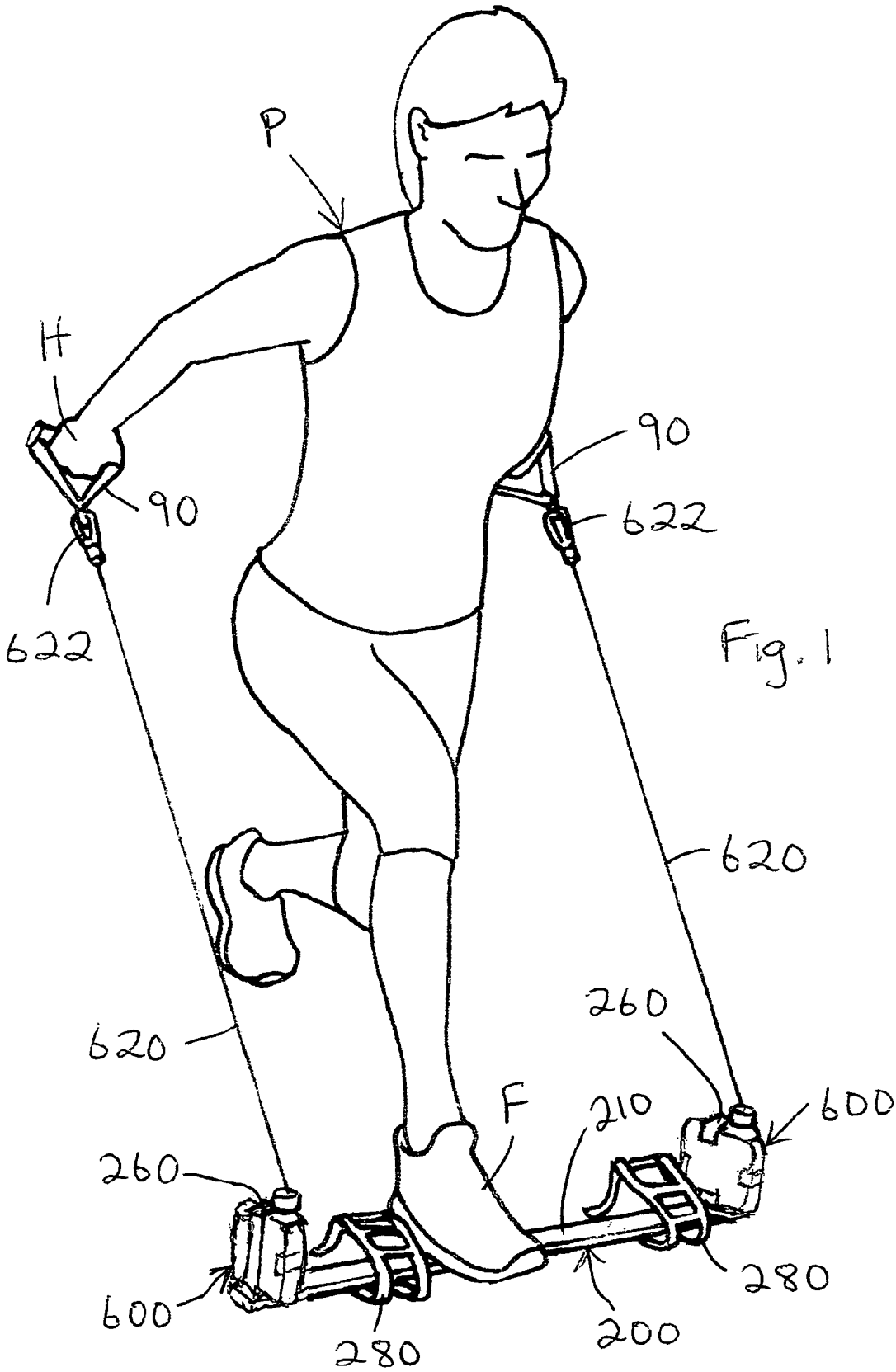
FIG. 1 is a perspective view a person performing a first exercise with exercise equipment configured and arranged in accordance with the present invention.

FIG. 1 shows a person P exercising with equipment configured and arranged according to the principles of the present invention. The person P is standing with one foot F on a base member 200. The base member 200 includes a flat elongate bar 210 that is preferably stamped from a sheet of steel. Left and right toe cups 280 are preferably secured to respective left and right segments of the bar 210. Each toe cup 280 is preferably a conventional bicycle toe cup that is secured to the bar 210 by at least one screw. The toe cups 280 are not used during the exercise shown in FIG. 1, but are useful for certain other types of exercise, including the exercise shown in FIG. 2, for example.

Left and right brackets 260 are secured to respective left and right ends of the bar 210. As shown in FIG. 6, each bracket 260 is sized and configured to receive and releasably retain a respective resistance device 600. In some respects, including certain aspects of construction, operation, and use, the resistance devices 600 are comparable to those disclosed in U.S. Pat. No. 6,726,607 to Ihli, and U.S. Pat. No. 7,087,001 to Ihli, both of which are incorporated herein by reference. On alternative embodiments, different types of resistance arrangements may be used in the alternative, including, for example, the isokinetic resistance devices disclosed in U.S. Pat. No. 5,511,740 to Loubert et al., which is also incorporated herein by reference. Operation of the resistance devices 600 is described with reference to FIGS. 4-5.

Figure 3:
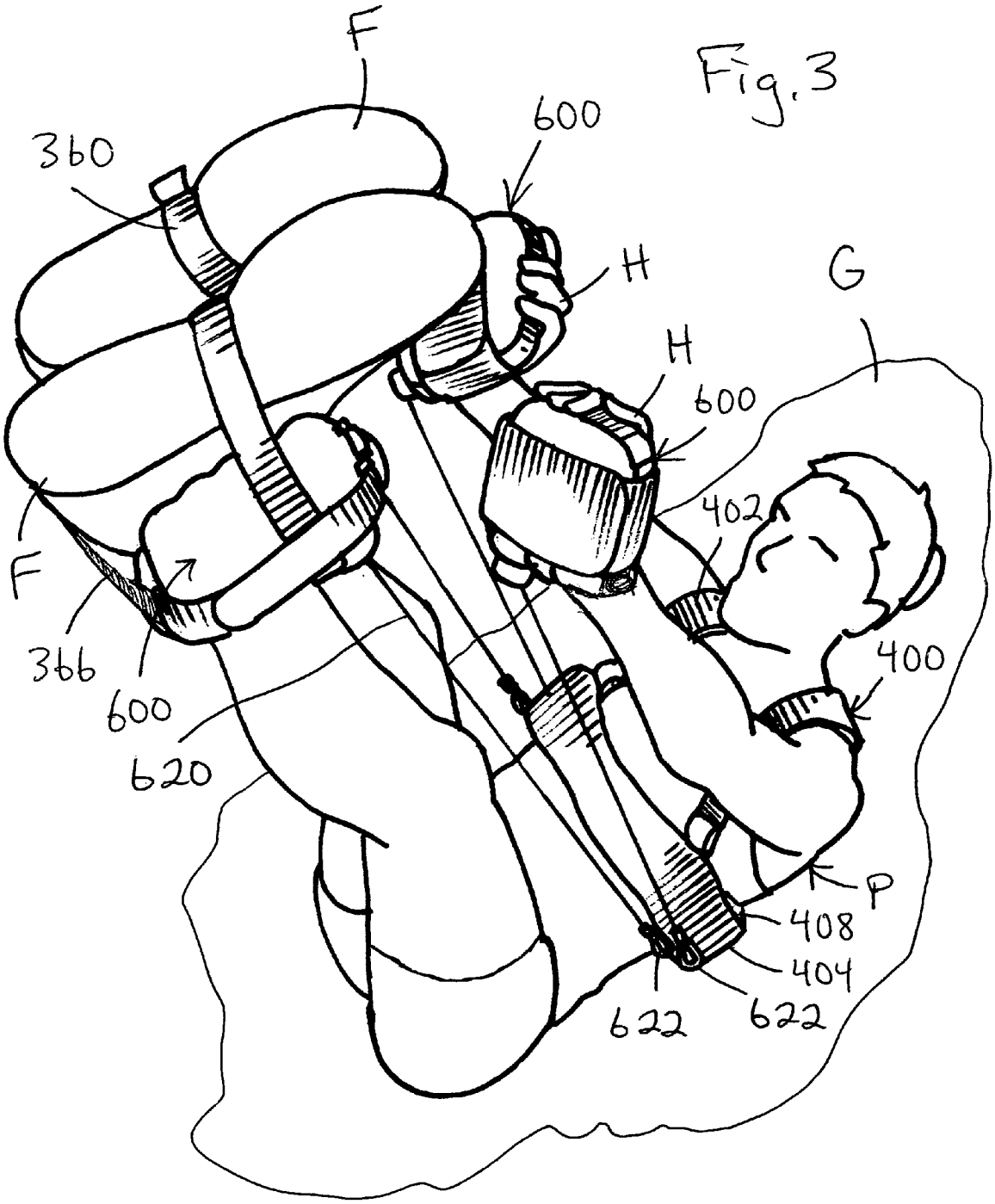
FIG. 3 is a perspective view of a person performing a third exercise with exercise equipment configured and arranged in accordance with the present invention.

Among other things, the resistance device 600 includes a housing 692 that defines notches at 12:00, 3:00, 6:00, and 9:00. At least the notches at 3:00 and 9:00 are interrupted by respective steel pins 698 that cooperate with the main body of the housing 692 to define strap receiving slots. A strap 606 is selectively inserted through each slot and secured to itself via hook and loop type fasteners. The strap 606 accommodates usage of the resistance device 800 as shown in FIG. 3.

Figure 7:
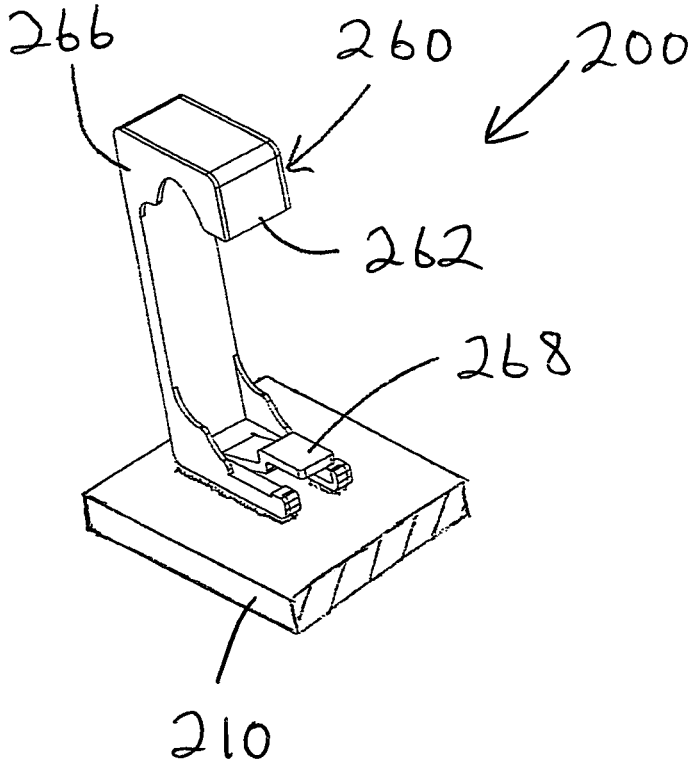
FIG. 7 is a partially sectioned perspective view of the base member of FIG. 6.

FIG. 7 shows one end of the base member 200 with the understanding that an opposite end is a mirror image thereof. A receptacle 260 is rigidly secured to an end of the base member bar 210. The receptacle 260 preferably includes a C-shaped frame member 262 and a somewhat similarly shaped latch member 266. The frame member 262 is preferably a flat steel bar that has been formed into the desired configuration, and welded in place onto the base member bar 210. A lower end of the frame member 262 is bifurcated or pronged for reasons discussed below. The latch member 266 is preferably an injection molded plastic part that fits into the frame member 262, and that is preferably secured in place by at least one screw. The latch member 266 defines an inwardly facing periphery that matches an external periphery defined by the resistance device housing 692.

Figure 2:
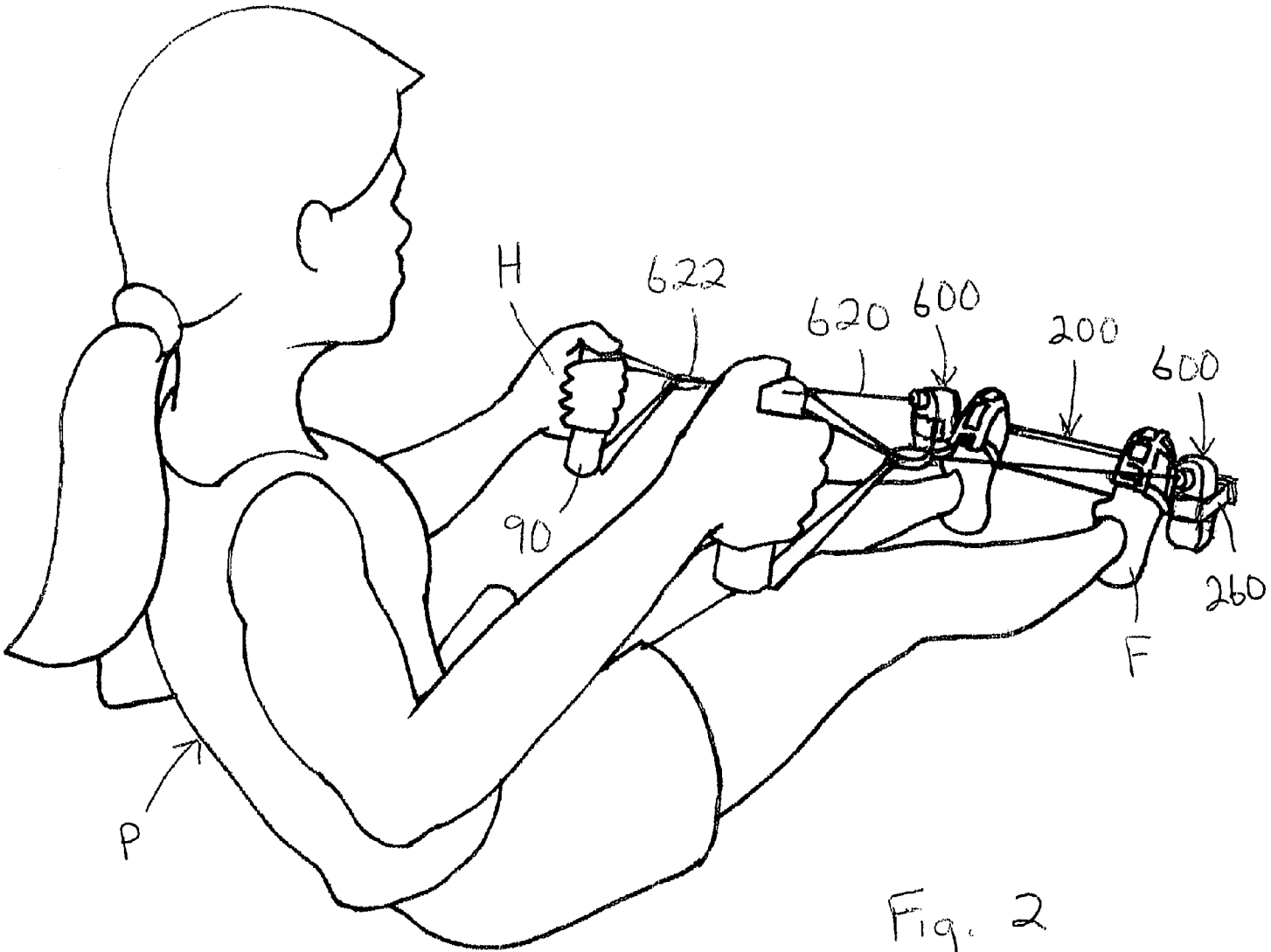
FIG. 2 is a perspective view of a person performing a second exercise with exercise equipment configured and arranged in accordance with the present invention.

FIG. 6 shows the resistance device 600 nested inside the receptacle 260 and ready for use as shown in FIGS. 1-2, for example. The resistance device 600 is moved into this arrangement by feeding the top of the housing 692 into the top of the receptacle 260, and then sliding the bottom of the housing 692 past a latch 268 on the receptacle 260. The latch 268 is configured to snap into alignment with a complementary portion of the resistance device housing 692 as the resistance device housing 692 arrives at the position shown in FIG. 6.

The latch 268 may be described as an integrally formed leaf spring on a lower end of the latch member 266. In order to remove the resistance device housing 692 from the receptacle 260, the latch 268 must be deflected downward between the pronged ends of the frame member 262. This arrangement facilitates convenient connection of the resistance device 600 to the base member 200, and convenient removal of the resistance device 600 from the base member 200. Moreover, the housing 692 is preferably configured to accommodate reorientation of the resistance device 600 relative to the receptacle 260 when the strap 606 is removed from the housing 692.

Figure 5:
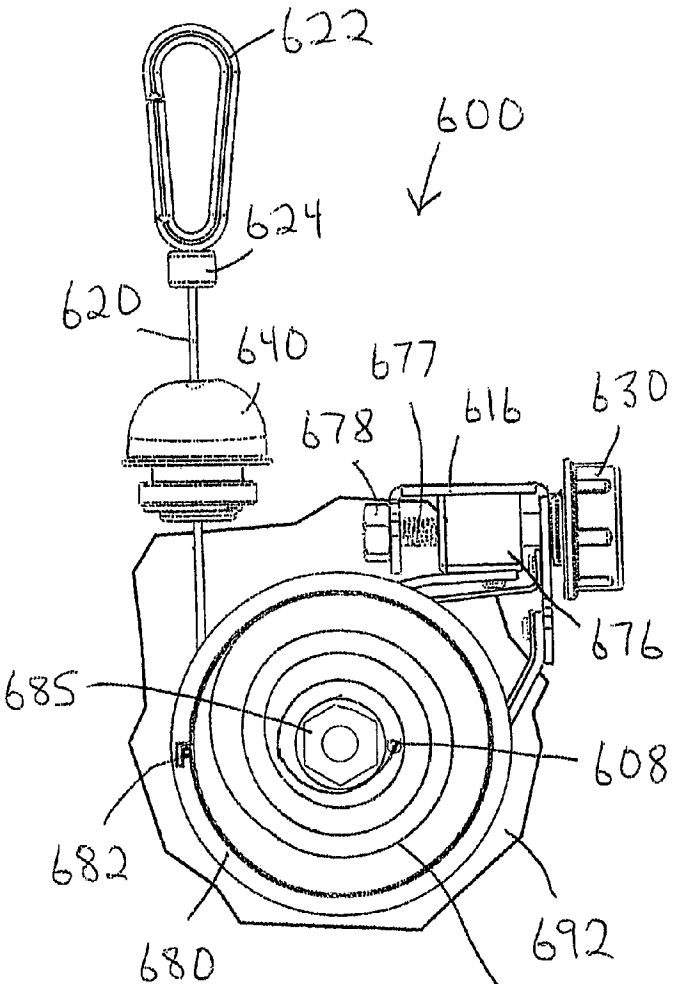
FIG. 5 is another partially sectioned front view of the resistance device of FIG. 4.
Figure 4:
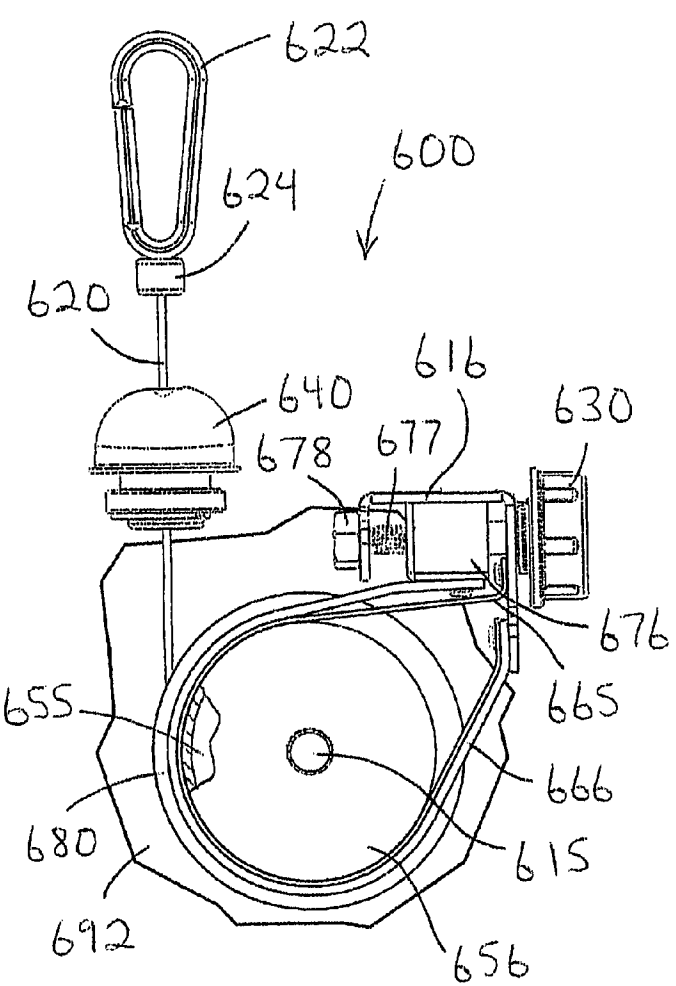
FIG. 4 is a partially sectioned front view of a resistance device that is shown in use in FIGS. 1-3.
Figure 6:
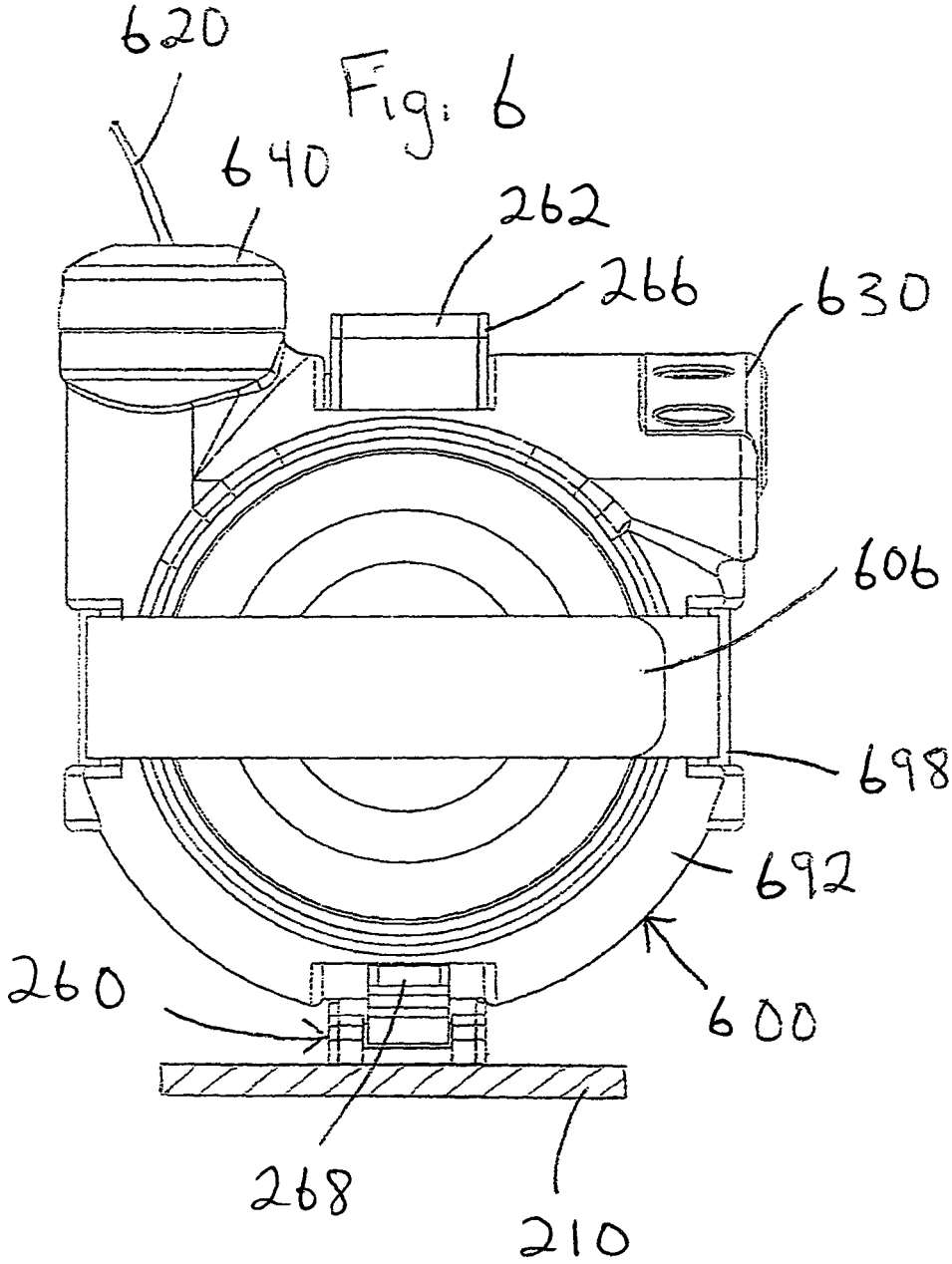
FIG. 6 is a partially sectioned end view of an alternative base member and an alternative embodiment resistance device that may be substituted for those shown in FIGS. 1-2.

FIGS. 4-5 show components of one of the resistance devices 600. Each resistance device 600 includes a flexible member or resistance cable 620 that is extracted from housing 692 when the extraction force exceeds an adjustable level of resistance, and that is rewound into the housing 692 when tension in the cable 620 falls below the rewind force exerted by a spring within the housing 692.

As shown in FIG. 4, the cable 620 is wound about a sheave 680, which in turn, is mounted on a rotatable shaft 615 via a conventional one-way clutch bearing 685. A hub 655 is rigidly secured to the shaft 615, and a steel cylindrical cap 656 is rigidly mounted on the hub 655 to define a resistance drum. A stainless steel brake band 666 is secured about a portion of the cap 656 with a Kevlar brake strip sandwiched therebetween. The brake band 666 cooperates with the resistance drum to provide resistance to rotation of the shaft 615 in either direction.

As shown in FIG. 5, a coiled rewind spring 690 is nested within a compartment defined by the sheave 680. An inner end of the spring 690 is anchored to the housing 692 via a peg 608, and an opposite, outer end of the spring 690 is anchored to the sheave 680 via a flange 682. As a result, the spring 690 biases the sheave 680 to rotate in a first rotational direction relative to the shaft 615 and the housing 692. The sheave 680 rotates together with the shaft 615 and relative to the housing 692 in an opposite, second rotational direction in response to extraction of the cable 620. Thereafter, when the cable 620 is released, the rewind spring 690 rotates the sheave 680 relative to the shaft 615 to retract the cable 620 within the housing 692.

A knob 630 is rotatably mounted on an end of the housing 692, and rotates relative to the housing 692 to adjust the level of resistance associated with the resistance drum. The housing 692 includes a bracket or frame member 616 that is preferably a stamped metal part. The frame member 616 is preferably secured in place between opposing "halves" of the housing 692 by means of internal structure on the housing shells, as well as fasteners that secure the halves to one another. A first rivet or other suitable fastener secures a first end of the brake strip 665 to a first portion of the frame member 616. A second rivet or other suitable fastener secures an opposite, second end of the brake strip 665 to a discrete, second portion of the frame member 616. The second rivet also preferably secures an end of the tension band 666 to the second portion of the frame member 616.

An opposite end of the tension band 666 is secured to a slide block 676 by means of a separate fastener, which is preferably a screw. The slide block 676 is threaded onto a bolt 677, and the slide block 676 bears against the frame member 616 in a manner that prevents rotation while allowing linear travel of the former relative to the latter. The bolt 677 is rotatably mounted within upper and lower openings in the frame member 616. An upper end of the bolt 677 is keyed to the knob 630, and a lower end of the bolt 677 is rigidly fastened to a nut 678. A thrust bearing is preferably disposed between the knob 630 and the frame member 616 to accommodate relative rotation therebetween. The foregoing elements cooperate to rotatably mount the bolt 677 in a specific position relative to the frame. A lower end of the frame member 616 is configured and arranged to limit downward travel of the slide block 676 along the bolt 677. On an alternative embodiment, a pin or other suitable stop is preferably secured to a lower section of the bolt 677 to function as the stopping means.

When the knob 630 is rotated in a first direction, tension in the tension band 666 increases, and when the knob 630 is rotated in an opposite, second direction, tension in the tension band 666 decreases. In either case, tension in the brake material 665 remains relatively unaffected, while compression of the brake material 665 against the cap 656 increases or decreases in direct relation to the change in tension in the tension band 666. On a working embodiment of the device 600, the resistance experienced by a user is smooth and predictable through a range of 2 to 40 pounds in response to less than two full rotations of the knob 630.

A re-directional bearing assembly 640 is movably mounted on top of the housing 692, and the cable 620 is routed through the re-directional bearing assembly 640 to accommodate extraction of the cable 620 in any direction having an upward component relative to the top of the housing 692. Persons skilled in the art will recognize that the re-directional bearing 640 is located at one of six available "corner locations" on the housing 692, and furthermore, that it need not occupy an orthogonal or parallel orientation relative to the longitudinal axis of the adjustment bolt 677.

A bead or stop 624 is rigidly secured to an external portion of the cable 620, and the bead 614 is too large to fit through the opening defined by the re-directional bearing assembly 640, thereby preventing the distal end of the cable 620 from becoming lost inside the housing 692. A carabineer clip 622 is connected to an outer distal end of the cable 620 to releasably connect the cable 620 to any of various force receiving members, including a conventional force receiving member, such as the handle shown in FIG. 11 of U.S. Pat. No. 7,087,001, for example.

FIGS. 1-2 show conventional left and right handles 90 connected to respective carabineers 622. Each handle 90 includes a strap having an intermediate portion routed through a hand grip tube, and opposite ends that are joined together about a ring. Each ring is clipped onto a respective carabineer 622 in FIGS. 1-2.

In FIG. 1, the person P is standing with one foot F on the base member 200, and with respective handles 90 in her left and right hands H. Among other things, this arrangement allows the person P to contemporaneously perform both a lunge exercise with her lower body and a low row to low press exercise with her upper body.

In FIG. 2, the person's left and right feet F are situated in respective toe cups 260 on the base member 200, and the person's left and right hands H are grasping respective left and right handles 90. The person P is sitting on a floor surface and using her feet F to hold the base member 200 at an elevation above the floor surface. Among other things, this arrangement allows the person P to perform a row-type exercise.

FIG. 3 shows two resistance devices 600 removed from the base member 200, and alternatively secured in respective hands H of a person P. Also, two additional resistance devices 600 are secured to the person's respective feet F, via respective foot straps 360 and 366. Each foot strap 360 is secured in a loop about a respective resistance device 600 and a central portion of the person's foot F. Each foot strap 366 is secured in a closed loop about a respective resistance device 600 and the person's ankle.

In FIG. 3, the person P is occupying a supine position on a floor surface G, with her arms and her legs extending generally perpendicularly upward from the ground surface G. The person is wearing a harness 400 having a torso belt 404 that forms a closed loop about her torso, and left and right shoulder straps 402 that extend over her shoulders and between front ends connected to respective front segments of the torso belt 404 and back ends connected to respective back segments of the torso belt 404. Left and right foam blocks 408 are secured to respective left and right sides of the torso belt 404, and connection rings are connected to the torso belt 404 at outboard locations relative to respective foam blocks 408. The foam blocks 408 move the rings away from the person's sides, and the rings are connected to respective carabineers 622. Among other things, this arrangement facilitates contemporaneous arm press and leg press exercises.

Figure 8:
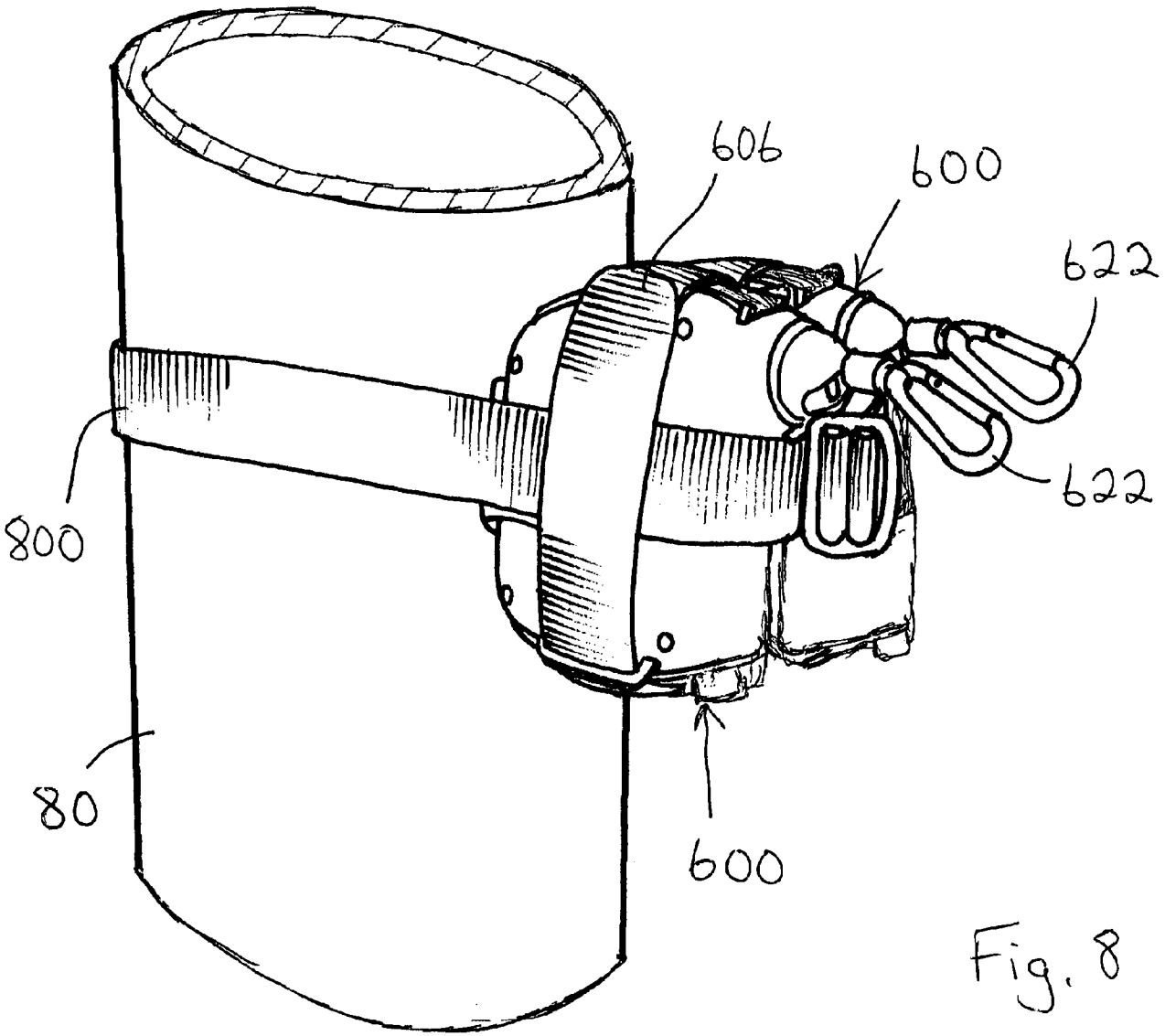
FIG. 8 is a perspective view of two of the resistance devices of FIGS. 4-5 configured and arranged to facilitate a fourth exercise in accordance with the present invention.

FIG. 8 shows two of the resistance devices 600 secured to an elongate vertical support structure 80, such as a pole, for example. A pole strap 800 forms a closed loop about the pole 80 and both of the resistance devices 600. Straps 606 extend about respective resistance devices 600, and about respective portions of the pole strap 800, as well. This arrangement facilitates a variety of lower body exercises when positioned a first distance above a ground surface, and a variety of upper body exercises when positioned a relatively greater, second distance above a ground surface.

Persons skilled in the art will recognize that the subject present invention may be described in terms of methods with reference to the foregoing embodiments. For example, the present invention may be described in terms of a method of exercise performed by a person using a kit including a left resistance device, a right resistance device, and a body harness. One such method involves donning the harness; securing the left resistance device in one's left hand; securing the right resistance device in one's right hand; connecting the harness to a flexible member emanating from the left resistance device; connecting the harness to a flexible member emanating from the right resistance device; moving one's left arm to extract the flexible member from the left resistance device; and moving one's right arm to extract the flexible member from the right resistance device.

The present invention may also be described in terms of a method of exercise performed by a person with a bar having a left resistance device mounted on its left end, and a right resistance device mounted on its right end. One such method involves alternative first and second modes of operation. In the first mode of operation, placing the bar on a support surface, and standing on an intermediate portion of the bar. In the second mode of operation, sitting on the support surface, and using one's feet to hold the bar at an elevation above the floor surface. In each said mode of operation, using one's left arm to extract a left flexible member from the left resistance device, and using one's right arm to extract a right flexible member from the right resistance device.

Recognizing that this disclosure will enable persons skilled in the art to derive various alternative embodiments and applications, the scope of the subject invention should be limited only to the extent of the claims set forth below.

What is claimed is:

1. An exercise kit for use by a person, comprising:

an elongate bar;

a left resistance device and a right resistance device, wherein each said resistance device is selectively mounted on a respective end of the bar, and a left leaf spring is mounted on the left side of the bar and movable between a latched position relative to the left resistance device, and an unlatched position relative to the left resistance device, and the leaf spring is biased toward the latched position;

a left force receiving member connected to a flexible member emanating from the left resistance device; and a right force receiving member connected to a flexible member emanating from the right resistance device.

2. The exercise kit of claim 1, further comprising left and right toe cups connected to respective left and right portions of the bar.

3. The exercise kit of claim 1, wherein each said force receiving member includes a handle.

4. The exercise kit of claim 1, wherein each said resistance device includes an outer housing and a strap which cooperate to selectively form a closed loop about a person's hand when the resistance device is removed from the base member.

5. An exercise kit for use by a person, comprising:

an elongate bar;

a left resistance device and a right resistance device, wherein each said resistance device is selectively mounted on a respective end of the bar;

left force receiving member connected to a flexible member emanating from the left resistance device;

a right force receiving member connected to a flexible member emanating from the right resistance device; and a harness, wherein each said force receiving member is selectively removed from a respective said resistance device, and each said flexible member is alternatively connected to a respective side of the harness, and each said resistance device is alternatively held in a person's respective hand.

6. The exercise kit of claim 5, further comprising at least one left hand strap sized and at least one right hand strap, wherein each said hand strap is configured and arranged to secure a respective said resistance device to a person's respective hand.

7. The exercise kit of claim 6, further comprising at least one left foot strap and at least one right foot strap, wherein each said foot strap is configured and arranged to alternatively secure a respective said resistance device to a person's respective foot.

8. The exercise kit of claim 5, further comprising at least one left foot strap and at least one right foot strap, wherein each said foot strap is configured and arranged to alternatively secure a respective said resistance device to a person's respective foot.

9. The exercise kit of claim 5, wherein each side of the harness defines at least one connection point, and the harness includes a left pad and a right pad, and each said pad is disposed between the person's torso and a respective said connection point.

10. The exercise kit of claim 1, wherein the bar has a length of at least two feet, a width of at least two inches, and a height of less than one inch.

11. An exercise kit for use by a person, comprising:

an elongate bar;

a first resistance device comprising a first housing and a first flexible member emanating from the first housing, wherein the first housing is releasably latched to a first end of the bar;

a second resistance device comprising a second housing and a second flexible member emanating from the second housing, wherein the second housing is releasably latched to an opposite, second end of the bar;

a first force receiving member connected to the first flexible member; and a second force receiving member connected to the second flexible member.

12. The exercise kit of claim 11, wherein a first strap cooperates with the first housing to form a closed loop about a person's hand when the first resistance device is removed from the bar.

13. The exercise kit of claim 11, wherein a second strap cooperates with the second housing to form a closed loop about a person's foot when the second resistance device is removed from the bar.

14. The exercise kit of claim 11, wherein the first resistance device is selectively latched in alternative first and second orientations relative to the bar.

15. The exercise kit of claim 14, wherein the bar is configured to occupy a stable operative position relative to an underlying floor surface, and the first flexible member emanates from the first housing at a first elevation above the floor surface when the first resistance device occupies the first of said orientations relative to the bar, and the first flexible member emanates from the first housing at a second, relatively greater elevation above the floor surface when the first resistance devices occupies the second of said orientations relative to the bar.

16. The exercise kit of claim 11, wherein a first C-shaped bracket is mounted on the first end of the bar, and a second C-shaped bracket is mounted on the second end of the bar, and each said housing is sized and configured to nest inside a respective said bracket.

17. The exercise kit of claim 16, wherein each said bracket includes a spring-biased latch that is movable into and out of engagement with a respective said housing.

18. The exercise kit of claim 11, wherein a first leaf spring is disposed on the first end of the bar and releasably biased into latching engagement with the first housing, and a second leaf spring is disposed on the second end of the bar and releasably biased into latching engagement with the second housing.

19. The exercise kit of claim 18, wherein each said leaf spring has a respective distal end that is sized and configured to be pressed by a person's thumb to release a respective said housing from engagement by a respective said latch.

* * * * *